United States Patent [19]

Zahka

[11] Patent Number: 4,727,705

[45] Date of Patent: Mar. 1, 1988

[54] PACKAGE FOR MEMBRANE FILTERS

[75] Inventor: Joseph G. Zahka, Dracut, Mass.

[73] Assignee: Millipore Corporation, Bedford, Mass.

[21] Appl. No.: 937,752

[22] Filed: Dec. 4, 1986

[51] Int. Cl.[4] ..... B65B 55/02

[52] U.S. Cl. ..... 53/425; 53/469; 206/205; 206/484; 210/493.5

[58] Field of Search ..... 206/205, 484, 439; 53/425, 469; 210/493.1, 493.2, 493.5, 500.1, 500.21, 500.23, 500.27, 510.1; 493/941

[56] References Cited

U.S. PATENT DOCUMENTS 3,754,368 8/1973 Moore et al. ..... 53/425
4,177,620 12/1979 Daly et al. ..... 53/425
4,295,563 10/1981 Becker et al. ..... 206/205

FOREIGN PATENT DOCUMENTS 0139822 5/1985 European Pat. Off. ..... 210/493.5
0318667 2/1957 Switzerland ..... 206/205

*Primary Examiner*—Jimmy G. Foster
*Attorney, Agent, or Firm*—Andrew T. Karnakis

[57] ABSTRACT

A hydrophobic membrane filter device is packaged in a moisture and bacteria impervious container with the pores of the membrane filter being filled with water. The package is then sterilized to kill any living organisms contained therein. Thereafter, a sufficient concentration of water is retained in the membrane pores thereby rendering the hydrophobic membrane filter device directly permeable to an aqueous fluid.

7 Claims, 1 Drawing Figure

PACKAGE FOR MEMBRANE FILTERS

FIELD OF INVENTION

Figure 1:
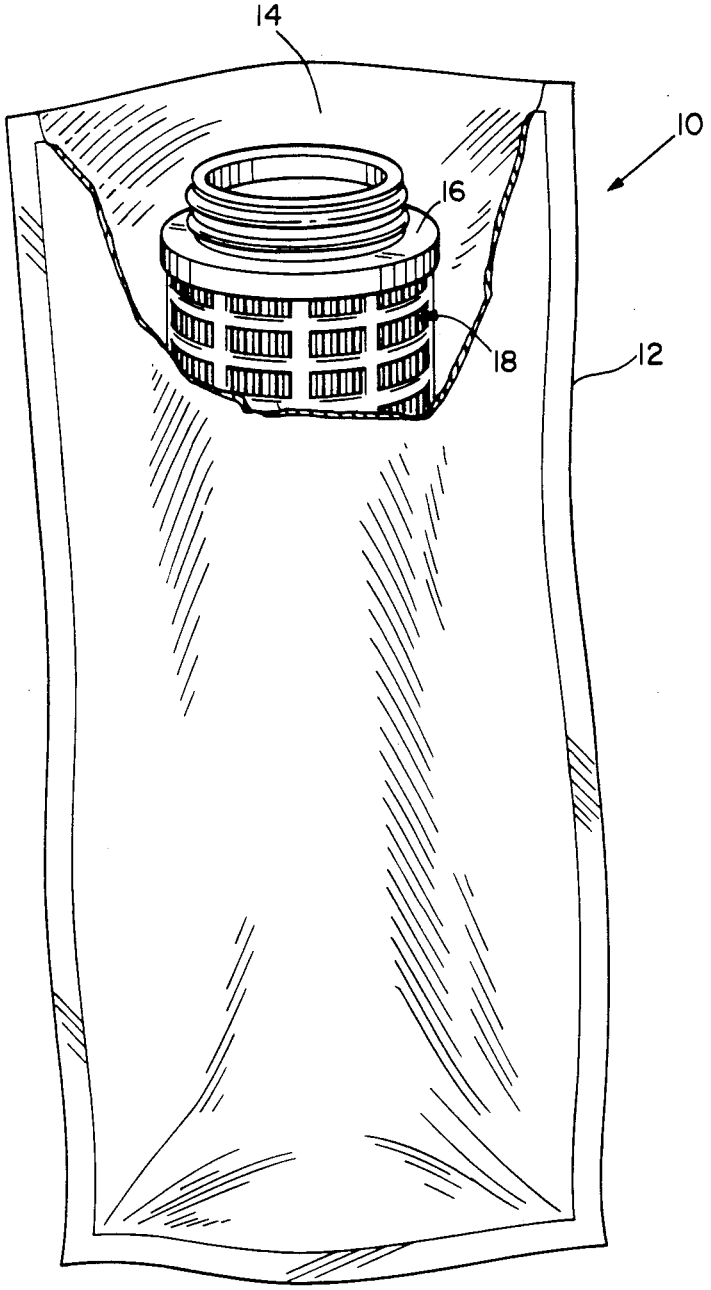

This invention relates generally to membrane filters, particularly such filters having a controlled and measurable pore size. More particularly this invention relates to method and apparatus for packaging hydrophobic membrane filters for shipment from a membrane filter manufacturer to an end user.

BACKGROUND OF INVENTION

The use of membrane filters for the purification and separation of materials within a fluid stream is a well developed art. As used herein the term membrane filter of filter includes semipermeable membranes formed of a solid polymeric matrix and having a controlled and measurable porosity. These filters are generally fabricated into devices, such as cartridges, which are adapted to be inserted within a fluid stream to effect the removal of particles and/or micro-organisms from liquids and gases.

Depending on the application, membrane filter devices must be compatible with a wide variety of chamicals and solvents. For example, in the manufacture of microelectronic circuits, membrane filters are used extensively to purify various process fluids to prevent contaminants from causing circuit failures and hence reducing manufacturing yields. The process fluids typically used in the manufacture of semiconductors are generally strong (i.e., chamically active) solvents, acids or bases. Therefore, such an application requires the use of a chemically inert filter, for example, a fluorocarbon based filter is often employed. Because these filters are hydrophobic, they are not spontaneously wet by aqueous based process fluids. Hydrophobic membrane filter devices which are intended for use in aqueous applications are generally packaged dry in a plastic bag. Thus the user is often required to pretreat the filter before using it in such process streams. This pretreatment is time consuming, may require the user to provide a separate installation to carry out the pretreatment and can often result in the introduction of contaminants downstream of the filter. Most often the prewetting agent used is alcohol, a flammable liquid, which presents safety concerns. This requires the end user prior to putting the filtration device into service to wet the filter with alcohol, followed by a water flush and then a flush with process solution. While manufacturers of membrane filter devices are accustomed to handling and pretreating hydrophobic filters, end users may not have the capabilities or the desire to perform such additional processing steps. Hence the notions of "user friendly" and "ready the use" are prevailing concepts in the art of membrane filtration.

Although the prevailing means for shipping hydrophobic filters is in a dry plastic bag, certain hydrophobic membranes, particularly ultrafiltration membranes, cannot be dried without damaging their structure. Thus these membranes are shipped wet, usually packaged with water and a preservative, such as glycerin and/or formaldehyde, the preservative serving to prevent the growth of bacteria present in the water. However, the preservative contained within the pore structure of the membrane will leach into the process fluid and can thus contaminate this fluid. Hence this packaging concept requires pretreatment with concomitant special handling by the user and suffers from the disadvantages referred to above. Moreover, elimination of the preservative will greatly reduce the shelf life of the membrane filter device due to high bacteria growth.

Thus the need still exists for an effective transport mechanism for hydrophobic membrane filters. That is a packaging concept which allows the customer to immediately install the membrane filter device in his process stream with minimal risk of contamination and minimal pretreatment would be highly desirable particularly for use in the semiconductor manufacturing industry.

SUMMARY OF THE INVENTION

The present invention overcomes the foregoing limitations and disadvantages of the prior art by providing an improved means for transporting membrane filters from a filter manufacturer to an end user. In accordance with a preferred embodiment, an unmodified hydrophobic membrane filter device, whose pores are filled with water only (with no other substance being present) in concentration to permit spontaneous wetting of the membrane by an aqueous fluid, is placed in the prewet state in a moisture and bacteria impervious container and sealed closed. The container, actually a composite plastic bag, is steam autoclaved to kill any organisms living in the water. Thereafter, the water remains in the membrane pores permitting the hydrophobic membrane to retain its prewet state. The package may then be shipped to an end user and stored for several weeks. Then, when appropriate, the membrane filter can be inserted directly into an industrial process stream without any additional handling or processing.

Other aspects, advantages and features of the present invention will become apparent from the following description taken in conjunction with the drawing.

DRAWINGS

FIG. 1 is a perspective view of a membrane filter package in accordance with an embodiment of the invention, partially cut away to show a filter cartridge contained therein.

PREFERRED EMBODIMENT

FIG. 1 shows a membrane filter package 10 constructed in accordance with the present invention. A composite plastic bag 12 which includes an inner layer of polypropylene and an outer mylar layer sandwiched around a thin aluminum sheet houses a filter cartridge 16. The construction of such a bag is well known; moveover, the details of the bag design are not essential to the present invention except for the ability of the bag to provide a moisture and bacteria impervious barrier. The top of the bag has an opening 14 sufficient to provide access for the filter cartridge. The opening 14 may be sealed closed by any conventional means, but heat sealing is preferred to avoid introduction of contaminants or extractables into the interior of the bag and hence to be exposed to the cartridge. The polypropylene inner layer facilitates the ability to heat seal the opening 14.

The cartridge 16 includes a membrane filter 18 constructed of a fluorocarbon based polymer such as polytetrafluoroethylene (PTFE) in a pleated configuration. An example of such a filter device is commercially available from Millipore Corporation under the brand designation Fluorogard TM. As is well known, PTFE is extremely hydrophobic and as a result does not spontaneously wet with water.

Techniques for water wetting hydrophobic membranes are known to those of skill in the art and include the use of high pressure to force intrusion of water into the pores of the membrane or the attachment of chemicals to the surface of the membrane to aid in water wetting. In accordance with the preferred embodiment, the PTFE membrane is prewet with alcohol, the alcohol then being displaced by immersion in a water bath and subsequent flushing with water. After the PTFE membrane filter 18 has been water wet in the foregoing manner, the membrane will wet spontaneously with any aqueous fluid stream.

The cartridge 16 is then placed prewet in the bag 12. A few milliliters of water is also included in the bag which is then heat sealed closed. The bag is autoclaved in a conventional steam chamber at a temperature of 121° C. for 30 to 60 minutes to sterilize the bag and filter by killing any living organisms contained within. Surprisingly at the conclusion of the autoclaving, the membrane 18 was found to retain a sufficient amount of water in its pores to render the cartridge directly permeable to an aqueous based fluid.

It is possible to perform testing to demonstrate the water wettability of hydrophobic membrane filters which is a function of pressure drop across the filter versus flow rate of water through the filter. A cartridge having a hydrophobic membrane filter was alcohol wet and water flushed as described above. The pressure drop across the filter at a flow rate of 2 gallons per minute of water at 25° C. was measured to be 1.3 psig. The same cartridge was placed in a bag in accordance with the invention, steam sterilized for 30 minutes at a temperature of 121° C., and then stored for four weeks.

Thereafter, the bag was opened and the cartridge was retested under the same conditions as before. The pressure drop was measured to be 1.6 psig. This indicates that most of the pores of the membrane remained full of water.

To prevent potential rupture of the bag 12 during steam sterilization, it has been found desirable to overpressurize the autoclave with air during the steam cycle. The pressure inside and outside of the bag is balanced by controlling the air pressure in the autoclave based on the temperature within the bag. After the bag cools, the vapor inside condenses reducing the internal pressure of the bag to atmospheric conditions.

As mentioned, after autoclaving is completed, water is retained in the pores of the hydrophobic membrane. The membrane containing package is then readied for shipment to a customer. Because living organisms have been killed, the shelf life of the packaged device is greatly prolonged thereby alleviating special storing requirements. Furthermore, the filter device when needed for use may simply be dispensed from the bag 12 and inserted directly in the process stream by the customer thus eliminating special handling and pretreatment.

Although an embodiment has thus been described in detail above, the foregoing example serving to further illustrate the teachings, advantages and surprising results of the present invention, such embodiments and examples are not intended to serve as a limitation to the scope of the invention.

What is claimed is:

1. A method of packaging a hydrophobic membrane filter comprising the steps of:

inserting said membrane filter into a moisture and bacteria impervious container, the pores of said membrane filter containing water and being substantially free of any other substance;

sealing said container after said filter is inserted therein to form a fluid and bacteria tight sealed package; and sterilizing said sealed package such that after said sterilizing step water is retained within said pores.

2. The method of claim 1 wherein said sterilizing step comprises steam sterilizing said sealed package.

3. The method of claim 1 including the step of adding water to said container prior to sealing thereof.

4. The method of claim 1 wherein said container is a composite plastic bag having an inner layer of polypropylene and an outer layer of mylar.

5. The method of claim 1 wherein said container is sealed closed by heat sealing.

6. The method of claim 1 where said membrane filter is a pleated cartridge filtration device.

7. The method of claim 2 wherein said steam sterilization step further includes the step of controlling the air pressure within and without said container.

* * * * *